US009829847B2

(12) United States Patent
Arai et al.

(10) Patent No.: US 9,829,847 B2
(45) Date of Patent: Nov. 28, 2017

(54) RECORDING MEDIUM TRANSPORTING DEVICE AND IMAGE FORMING APPARATUS

(71) Applicant: FUJI XEROX CO., LTD., Tokyo (JP)

(72) Inventors: Mizuki Arai, Kanagawa (JP); Hiromitsu Tomioka, Kanagawa (JP); Kohei Takahashi, Kanagawa (JP); Riwako Miyauchi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/050,924

(22) Filed: Feb. 23, 2016

(65) Prior Publication Data

US 2017/0090380 A1 Mar. 30, 2017

(30) Foreign Application Priority Data

Sep. 24, 2015 (JP) ..... 2015-187337

(51) Int. Cl.

| | |
|---|---|
| ***G03G 15/00*** | (2006.01) |
| ***B65H 5/06*** | (2006.01) |
| ***B65H 5/26*** | (2006.01) |
| ***B65H 29/12*** | (2006.01) |
| ***B65H 29/60*** | (2006.01) |

(52) U.S. Cl.

CPC ..... *G03G 15/6529* (2013.01); *B65H 5/068* (2013.01); *B65H 5/26* (2013.01); *B65H 29/12* (2013.01); *B65H 29/60* (2013.01); *B65H 2402/441* (2013.01); *B65H 2402/45* (2013.01); *B65H 2801/12* (2013.01)

(58) Field of Classification Search

CPC ..... G03G 15/6529

See application file for complete search history.

(56) References Cited

U.S. PATENT DOCUMENTS 5,839,032 A * 11/1998 Yasui ..... G03G 15/231 271/184
8,045,888 B2 * 10/2011 Nanno ..... G03G 15/234 399/124
2004/0175210 A1 * 9/2004 Otaka ..... B65H 5/062 399/318

(Continued)

FOREIGN PATENT DOCUMENTS

JP 2002-91106 A 3/2002

*Primary Examiner* — Ryan Walsh
(74) *Attorney, Agent, or Firm* — Sughrue Mion, PLLC

(57) ABSTRACT

A recording medium transporting device includes a transport path, a first open-close portion, and a second open-close portion. A recording medium on which an image is formed is transported over the transport path. The first open-close portion is disposed on a side surface of the transporting device so as to be openable to cover and closeable to uncover the transporting device. The first open-close portion renders a first portion of the transport path open when the first open-close portion is opened so as to uncover the transporting device. The second open-close portion is located inside the transporting device at a position further inward of the first open-close portion so as to be openable to cover and closeable to uncover the transporting device. The second open-close portion renders a second portion of the transport path open when the second open-close portion is opened so as to uncover the transporting device.

11 Claims, 8 Drawing Sheets

(56) References Cited

U.S. PATENT DOCUMENTS

| | | | | |
|---|---|---|---|---|
| 2005/0036804 | A1* | 2/2005 | Yokoi | G03G 15/0194 399/124 |
| 2007/0036585 | A1* | 2/2007 | Ochi | G03G 21/1633 399/121 |
| 2010/0098473 | A1* | 4/2010 | Hosoi | B65H 5/38 399/400 |
| 2010/0327522 | A1* | 12/2010 | Seike | B65H 29/14 271/279 |
| 2010/0329738 | A1* | 12/2010 | Shirai | G03G 15/231 399/124 |
| 2013/0249161 | A1* | 9/2013 | Uchino | B65H 3/0684 271/9.01 |
| 2015/0084272 | A1* | 3/2015 | Maruyama | G03G 15/6529 271/226 |

* cited by examiner 96B
96A
70
F
R
93
84
96
95
F1
VIIB
z
x
y
-x

RECORDING MEDIUM TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2015-187337 filed Sep. 24, 2015.

BACKGROUND

Technical Field

The present invention relates to recording medium transporting devices and image forming apparatuses.

SUMMARY

According to an aspect of the invention, a recording medium transporting device includes a transport path, a first open-close portion, and a second open-close portion. A recording medium on which an image is formed is transported over the transport path. The first open-close portion is disposed on a side surface of the transporting device so as to be openable to uncover and closeable to cover the transporting device. The first open-close portion renders a first portion of the transport path open when the first open-close portion is opened so as to uncover the transporting device. The second open-close portion is disposed inside the transporting device at a position further inward of the first open-close portion so as to be openable to cover and closeable to uncover the transporting device. The second open-close portion renders a second portion of the transport path different from the first portion of the transport path open when the second open-close portion is opened so as to uncover the transporting device.

BRIEF DESCRIPTION OF THE DRAWINGS

An exemplary embodiment of the present invention will be described in detail based on the following figures, wherein.

DETAILED DESCRIPTION

Description of Image Forming System

Referring now to the appended drawings, an exemplary embodiment of the invention is described in detail below.

Figure 1:
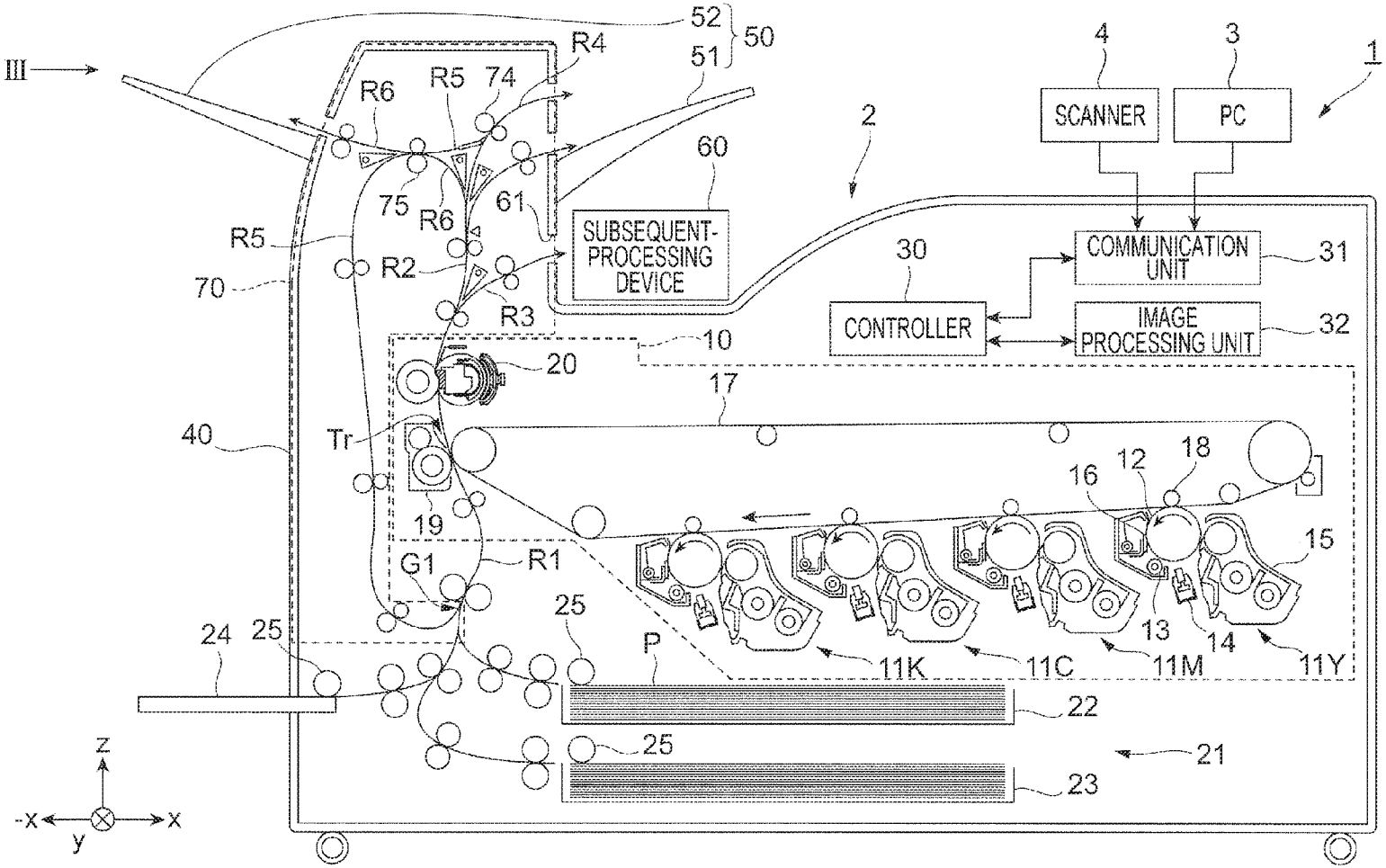
FIG. 1 is an entire configuration diagram of an image forming system according to an exemplary embodiment.

FIG. 1 is an entire configuration diagram of an image forming system 1 according to an exemplary embodiment. FIG. 1 is a perspective view of the image forming system 1 when viewed from a front side F at which the image forming system 1 receives commands or operations from users.

The image forming system 1 illustrated in FIG. 1 is a so-called tandem color printer. The image forming system 1 includes an image forming section 10, which forms images on the basis of image data, and a sheet feeding section 21, which feeds sheets P to the image forming section 10.

The image forming system 1 also includes a sheet transporting section 70, which transports sheets P on which images have been formed by the image forming section 10, and sheet ejection portions 50, to which the sheets P on which images have been formed are ejected. The image forming system 1 also includes a subsequent-processing device 60 disposed to the right of the sheet transporting section 70 in FIG. 1. The subsequent-processing device 60 includes components such as a sheet stacking unit, which receives and bundles sheets P on which images have been formed, and a fastening unit, which fastens sheets P together at the end portions of the sheets P. The image forming system 1 also includes an ejection port 61, through which the sheets P on which images have been formed are ejected to the subsequent-processing device 60.

The image forming system 1 also includes a housing 40 that accommodates and holds the image forming section 10, the sheet feeding section 21, and the sheet transporting section 70. The image forming system 1 also includes a controller 30, which controls the entire operation of the image forming system 1, a communication unit 31, which communicates with other devices such as a personal computer (PC) 3 or an image reading device (scanner) 4 and receives image data from the devices, and an image processing unit 32, which performs predetermined image processing on the image data received by the communication unit 31.

In the following description, the direction from the lower side to the upper side of the image forming system 1 is referred to as a z direction, the direction from the front side F to the rear side R of the image forming system 1 is referred to as a y direction, and the direction perpendicular to the z direction and the y direction and from the left side to the right side of the image forming system 1 when viewed from the front side F is referred to as an x direction.

The sheet feeding section 21 includes a first sheet-feed tray 22 and a second sheet-feed tray 23, from which sheets P are fed to a first sheet-transport path R1. The first sheet-feed tray 22 and the second sheet-feed tray 23 have a similar configuration. The sheet feeding section 21 also includes a manual feed tray 24 used for manually feeding sheets P. The sheet feeding section 21 also includes pick-up rollers 25 disposed over the first sheet-feed tray 22, the second sheet-feed tray 23, and the manual feed tray 24 at positions downstream of the respective trays 22, 23, and 24 in the direction in which the sheets P are transported, or, a transportation direction. Each pick-up roller 25 picks up the sheets P and transports the sheets P to a second transfer position Tr of the image forming section 10 along the transport path extending from the corresponding tray 22, 23, or 24. The transport paths extending from the first sheet-feed tray 22, the second sheet-feed tray 23, and the manual feed tray 24 merge with one another at a merging point G1, which is an upstream end of the first sheet-transport path R1.

The image forming section 10 includes four image forming units 11Y, 11M, 11C, and 11K (hereinafter collectively referred to as image forming units 11) for yellow (Y), magenta (M), cyan (C), and black (K), disposed in parallel at regular intervals. Each image forming unit 11 includes a photoconductor drum 12, which allows an electrostatic latent image to be formed thereon and holds a toner image, a charging device 13, which charges the surface of the photoconductor drum 12 with electricity, and an exposure device 14, which exposes the photoconductor drum 12 charged by the charging device 13 with light on the basis of image data. Each image forming unit 11 also includes a developing device 15, which develops an electrostatic latent image formed on the photoconductor drum 12, and a cleaner 16, which cleans the surface of the photoconductor drum 12 after transfer.

The image forming section 10 also includes an intermediate transfer belt 17, on which toner images of different colors formed on the photoconductor drums 12 of the respective image forming units 11 are transferred so as to be superposed one on top of another, first transfer rollers 18, which sequentially transfer (first-transfer) toner images of different colors of the corresponding image forming units 11 to the intermediate transfer belt 17, a second transfer roller 19, which collectively transfers (second-transfers) the superposed toner images transferred onto the intermediate transfer belt 17 to a sheet P, and a fixing device 20, which fixes the second-transferred images to the sheet P.

The sheet ejection portions 50 include a side tray 52, disposed on a first side surface of the sheet transporting section 70, and an ejection tray 51, disposed on a second side surface of the sheet transporting section 70, the second side surface facing in the x direction of FIG. 1, that is, opposite to the side surface on which the side tray 52 is disposed.

The side tray 52 is disposed on the left side of the sheet transporting section 70 in FIG. 1. Sheets P subjected to single-side printing are ejected to the side tray 52 while their surfaces on which images are formed face up.

The ejection tray 51 is disposed on the right side of the sheet transporting section 70 in FIG. 1. Sheets P subjected to single-side printing are ejected to the ejection tray 51 while their surfaces on which images are not formed face up.

Here, the ejection tray 51, the side tray 52, and the ejection port 61 are examples of ejection portions.

An image forming system 1 according to this exemplary embodiment is a so-called a color printer, which forms images of colors Y, M, C, and K on a sheet P. The image forming system 1, however, is not limited to a color printer. The image forming system 1 may be, for example, a so-called monochrome printer, which forms monochrome images on a sheet P.

The image forming apparatus 2 according to this exemplary embodiment includes the image forming section 10, the sheet feeding section 21, the housing 40, the sheet transporting section 70, the sheet ejection portions 50, and the ejection port 61.

Description of Sheet Transporting Section

Subsequently, the sheet transporting section 70 that transports sheets P on which images have been formed is described.

Figure 2:
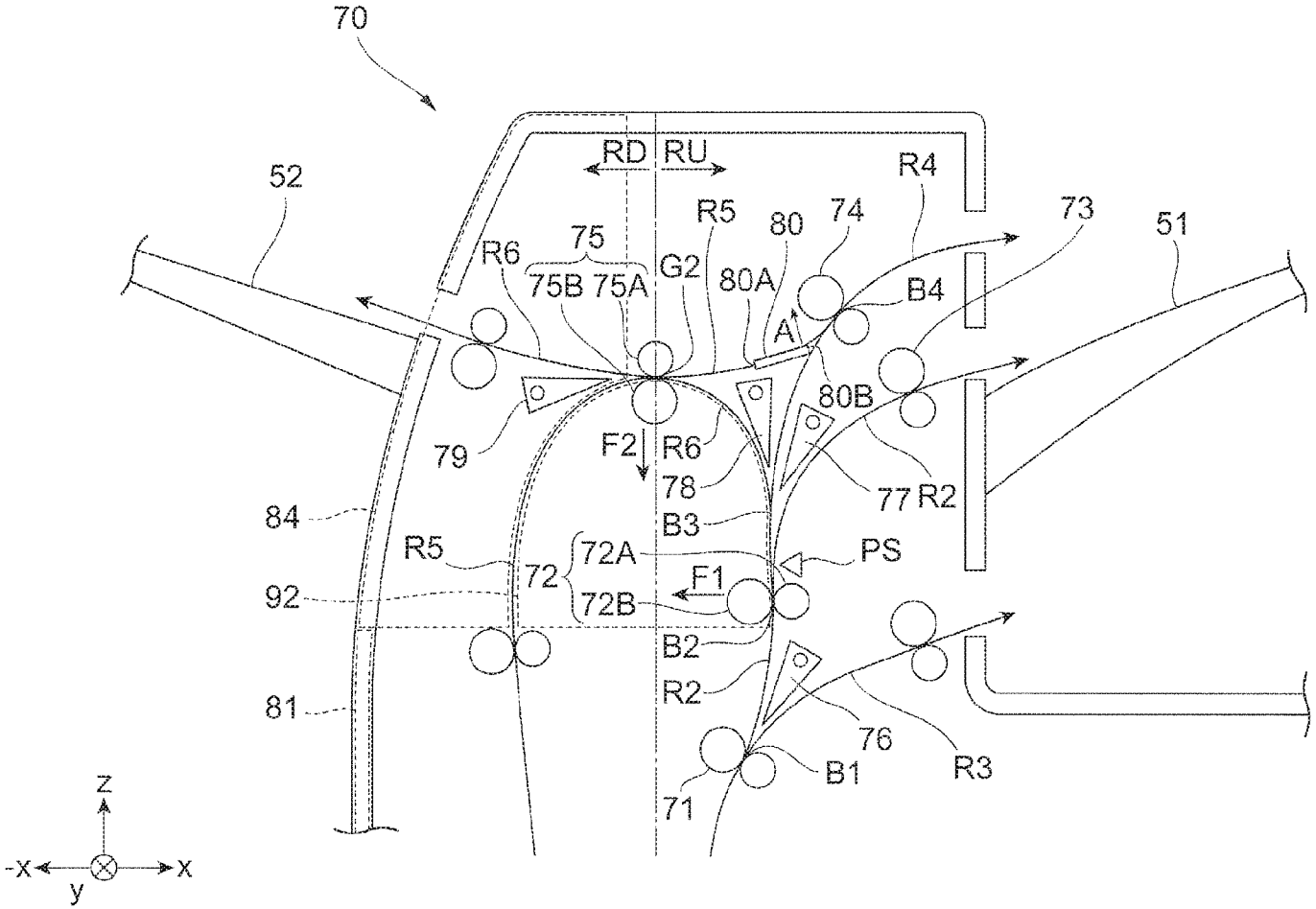
FIG. 2 is an enlarged diagram of a sheet transporting section.

FIG. 2 is an enlarged diagram of the sheet transporting section 70 of the image forming system 1.

The sheet transporting section 70, which is an example of a recording medium transporting device, includes first transport rollers 71, which transport sheets P on which images have been formed by the image forming section 10 downward in the transportation direction, and second transport rollers 72, which transport the sheets P that have been transported thereto by the first transport rollers 71 further downward in the transportation direction. The sheet transporting section 70 also includes third transport rollers 73, which transport the sheets P that have been transported thereto by the second transport rollers 72 toward the ejection tray 51, and reverse transport rollers 74, which reverse the transportation direction of the sheets P that have been transported thereto by the second transport rollers 72. The sheet transporting section 70 also includes diverging rollers 75, which transport the sheets P transported thereto after their transportation direction is reversed by the reverse transport rollers 74 toward the side tray 52 or back to a second transfer position Tr.

The sheet transporting section 70 also includes a second sheet transport path R2, which extends upward from the image forming section 10 for transporting the sheets P to the ejection tray 51, and a third sheet transport path R3, which diverges rightward in FIG. 2 from the second sheet transport path R2 at a position between the first transport rollers 71 and the second transport rollers 72 for transporting the sheets P to the subsequent-processing device 60. The sheet transporting section 70 also includes a fourth sheet transport path R4, which diverges upward from the second sheet transport path R2 at a position downstream of the second transport rollers 72 in the transportation direction and is curved rightward in FIG. 2 for transporting the sheets P to the reverse transport rollers 74, and a fifth sheet transport path R5, which diverges leftward in FIG. 2 from the fourth sheet transport path R4 and extends downward for transporting the sheet P to a merging point G1 again.

The sheet transporting section 70 also includes a sixth sheet transport path R6, which diverges leftward in FIG. 2 from the fourth sheet transport path R4 at a portion of the fourth sheet transport path R4 upstream of the reverse transport rollers 74 for transporting the sheets P to the side tray 52.

Although the fifth sheet transport path R5 and the sixth sheet transport path R6 cross each other in the middle of the transport paths, the paths R5 and R6 are separately provided. The second sheet transport path R2, the third sheet transport path R3, the fourth sheet transport path R4, the fifth sheet transport path R5, and the sixth sheet transport path R6 are examples of transport paths.

The sheet transporting section 70 includes a first switching gate 76, which is disposed near a diverging point B1 between the second sheet transport path R2 and the third sheet transport path R3 and switches the transportation route of the sheets P between the second sheet transport path R2 and the third sheet transport path R3. The sheet transporting section 70 also includes a second switching gate 77, which is disposed near a diverging point B2 between the second sheet transport path R2 and the fourth sheet transport path R4 and switches the transportation route of the sheets P between the second sheet transport path R2 and the fourth sheet transport path R4. The sheet transporting section 70 also includes a third switching gate 78, which is disposed near a diverging point B3 between the fourth sheet transport path R4 and the sixth sheet transport path R6 and switches the transportation route of the sheets P between the fourth sheet transport path R4 and the sixth sheet transport path R6. The sheet transporting section 70 also includes a fourth switching gate 79, which is disposed near a merging point G2 at which the fifth sheet transport path R5 and the sixth sheet transport path R6 merge with each other and switches the transportation route of the sheets P between the fifth sheet transport path R5 and the sixth sheet transport path R6.

The sheet transporting section 70 also includes a one-way transport gate 80, which is disposed near the diverging point B4 between the fourth sheet transport path R4 and the fifth sheet transport path R5 and guides the sheets P to the downstream side of the fourth sheet transport path R4. The sheet transporting section 70 also includes a position sensor PS, which is disposed near the diverging point B2 and detects the leading ends of the sheets P transported by the second transport rollers 72 over the second sheet transport path R2.

The sheet transporting section 70 also includes a downstream path cover 84 disposed so as to be openable and closable by rotation and a lower cover 81 disposed below the downstream path cover 84 so as to be openable and closable by rotation. The downstream path cover 84 and the lower cover 81 constitute parts of the housing 40 and are disposed on the first side surface of the sheet transporting section 70 on which the side tray 52 is disposed. The sheet transporting section 70 also includes an upstream path cover 92 disposed inside the housing 40 so as to be openable and closeable by rotation. The downstream path cover 84, the lower cover 81, and the upstream path cover 92 are described in detail below.

In the following description, portions of sheet transport paths located downstream of the diverging rollers 75 in the transportation direction are collectively referred to as a downstream path RD, which is an example of a first transport path. In other words, the downstream path RD includes portions of sheet transport paths located in an area extending from the diverging rollers 75 toward the downstream path cover 84 (leftward in FIG. 2). Portions of sheet transport paths located upstream of the diverging rollers 75 in the transportation direction are collectively referred to as an upstream path RU, which is an example of a second transport path. In other words, the upstream path RU includes portions of sheet transport paths located in an area extending from the diverging rollers 75 toward the ejection tray 51 (further rightward in FIG. 2).

The first transport rollers 71 transport sheets P on which images have been formed to the second sheet transport path R2 or the third sheet transport path R3.

The first switching gate 76 is disposed in such a manner as to be allowed to protrude over the second sheet transport path R2 and the third sheet transport path R3. When the transportation route of a sheet P transported by the first transport rollers 71 is to be switched to the third sheet transport path R3, the first switching gate 76 protrudes over the second sheet transport path R2 to guide the sheet P to the third sheet transport path R3. When, on the other hand, the transportation route of a sheet P is to be switched to the second sheet transport path R2, the first switching gate 76 protrudes over the third sheet transport path R3 to guide the sheet P to the downstream side of the second sheet transport path R2.

The second transport rollers 72, which are examples of an upstream transporting portion, include a roller 72A and a roller 72B, which are a pair of rollers that transport sheets P by rotation. The roller 72A is disposed on the downstream side of the roller 72B in the x direction in FIG. 2. The roller 72A faces the roller 72B with the second sheet transport path R2 interposed therebetween. Each of the rollers 72A and 72B has a rotation shaft, not illustrated, extending in the y direction in FIG. 2 from the front side F to the rear side R.

The roller 72B receives a pressing force (nip pressure) exerting in the x direction in FIG. 2 from its rotation shaft. Thus, the roller 72B pushes a sheet P transported over the second sheet transport path R2, in cooperation with the roller 72A. The rotation shaft of the roller 72B is provided with a spring, not illustrated, extending toward the rotation shaft of the roller 72A. The spring exerts a pressing force F1 in the −x direction in FIG. 2 on the rotation shaft of the roller 72B as a reaction force against the nip pressure received from the rotation shaft of the roller 72B. This pressing force F1 is transmitted to the upstream path cover 92 and the downstream path cover 84 via the rotation shaft of the roller 72B.

The second transport rollers 72 transport the sheet P, which the first switching gate 76 has been guiding to the second sheet transport path R2, to the downstream side of the second sheet transport path R2, to the fourth sheet transport path R4, or to the sixth sheet transport path R6.

The position sensor PS detects passing of the leading end of each sheet P transported by the second transport rollers 72 and, upon detection, transmits a detection signal to the controller 30. The controller 30 receives the signal from the position sensor PS and acquires information on the position of the sheet P. The controller 30 thus controls transportation of sheets P so that a sheet P transported over the fifth sheet transport path R5 and another sheet P transported over the sixth sheet transport path R6 do not come into contact with each other.

The second switching gate 77 is disposed so as to be allowed to protrude over the second sheet transport path R2 and the fourth sheet transport path R4. When the transportation route of a sheet P transported by the second transport rollers 72 is to be switched to the fourth sheet transport path R4, the second switching gate 77 protrudes over the second sheet transport path R2 to guide the sheet P to the fourth sheet transport path R4. On the other hand, when the transportation route of a sheet P is to be switched to the second sheet transport path R2, the second switching gate 77 protrudes over the fourth sheet transport path R4 to guide the sheet P to the downstream side of the second sheet transport path R2.

The third transport rollers 73 include a pair of rollers, which are a pressing roller and a driving roller. The third transport rollers 73 transport the sheet P, which the second switching gate 77 guides to the second sheet transport path R2, toward the ejection tray 51.

The third switching gate 78 is disposed so as to be allowed to protrude over the fourth sheet transport path R4 and the sixth sheet transport path R6. When the transportation route of the sheet P transported by the second transport rollers 72 is to be switched to the sixth sheet transport path R6, the third switching gate 78 protrudes over the fourth sheet transport path R4 to guide the sheet P to the sixth sheet transport path R6. On the other hand, when the transportation route of the sheet P is to be switched to the fourth sheet transport path R4, the third switching gate 78 protrudes over the sixth sheet transport path R6 to guide the sheet P to the downstream side of the fourth sheet transport path R4.

The one-way transport gate 80 is continuous with a wall surface (not illustrated) constituting the fifth sheet transport path R5 at its first end 80A. A second end 80B of the one-way transport gate 80 is disposed on a wall surface (not illustrated) constituting the fourth sheet transport path R4 at a portion upstream of the diverging point B4. When a sheet P transported over the fourth sheet transport path R4 comes into contact with the one-way transport gate 80, the one-way transport gate 80 is pushed aside by the sheet P and elastically deformed in such a manner that its second end 80B moves in the direction of arrow A in FIG. 2. Thus, the transport path of the sheet P is ensured, so that the sheet P is allowed to be transported toward the reverse transport rollers 74.

On the other hand, even when the sheet P transported by the reverse transport rollers 74 in the reverse direction comes into contact with an upper portion of the one-way transport gate 80, the wall surface constituting the fourth sheet transport path R4 located below the one-way transport gate 80 restricts downward movement of the one-way transport gate 80. Thus, the second end 80B of the one-way transport gate 80 does not move. The sheet P is thus transported to the fifth sheet transport path R5 while being guided by the one-way transport gate 80.

The one-way transport gate 80 may have a configuration similar to that of the first switching gate 76. In this case, when a sheet P is to be transported over the fourth sheet transport path R4, the one-way transport gate 80 is retracted from the fourth sheet transport path R4. When the sheet P is to be transported over the fifth sheet transport path R5 in the reverse direction, the one-way transport gate 80 protrudes over the fourth sheet transport path R4 to guide the sheet P to the downstream side of the fifth sheet transport path R5.

The reverse transport rollers 74 include a pair of rollers, that is, a pressing roller and a driving roller. The reverse transport rollers 74 rotate (forward) in such a direction that the sheet P transported over the fourth sheet transport path R4 is transported further downstream. The reverse transport rollers 74 also rotate in the reverse direction when the trailing end of the sheet P passes through the one-way transport gate 80 to transport the sheet P toward the fifth sheet transport path R5.

The diverging rollers 75, which are examples of a downstream transporting portion, include a roller 75A and a roller 75B. The rollers 75A and 75B are a pair of rollers that transport the sheets P by rotation. The roller 75A is disposed above the roller 75B and faces the roller 75B with the merging point G2 interposed therebetween. Each of the rollers 75A and 75B includes a rotation shaft, not illustrated, disposed so as to extend in the y direction in FIG. 2 from the front side F to the rear side R. The roller 75B receives an upward pressing force (nip pressure) from its rotation shaft. Thus, the roller 75B pushes the sheet P passing the merging point G5 in cooperation with the roller 75A.

The rotation shaft of the roller 75B is provided with a spring, not illustrated, extending toward the rotation shaft of the roller 75A. The spring exerts a downward pressing force F2 on the rotation shaft of the roller 75B as a reaction force against the nip pressure received from the rotation shaft of the roller 75B. This pressing force F2 is transmitted to the upstream path cover 92 via the rotation shaft of the roller 75B.

The diverging rollers 75 transport the sheet P transported over the fifth sheet transport path R5 to the downstream side of the fifth sheet transport path R5. The diverging rollers 75 also transport the sheet P transported over the sixth sheet transport path R6 toward the side tray 52.

The fourth switching gate 79 is disposed so as to be allowed to protrude over the fifth sheet transport path R5 and the sixth sheet transport path R6. When the transportation route of a sheet P is to be switched to the sixth sheet transport path R6, the fourth switching gate 79 protrudes over the fifth sheet transport path R5 to guide the sheet P to the sixth sheet transport path R6. On the other hand, when the transport route of a sheet P is to be switched to the fifth sheet transport path R5, the fourth switching gate 79 protrudes over the sixth sheet transport path R6 to guide the sheet P to the downstream side of the fifth sheet transport path R5.

Description of Configuration of Lower Cover and Downstream Path Cover

Subsequently, the configuration of the lower cover 81 and the downstream path cover 84 is described.

Figure 3:
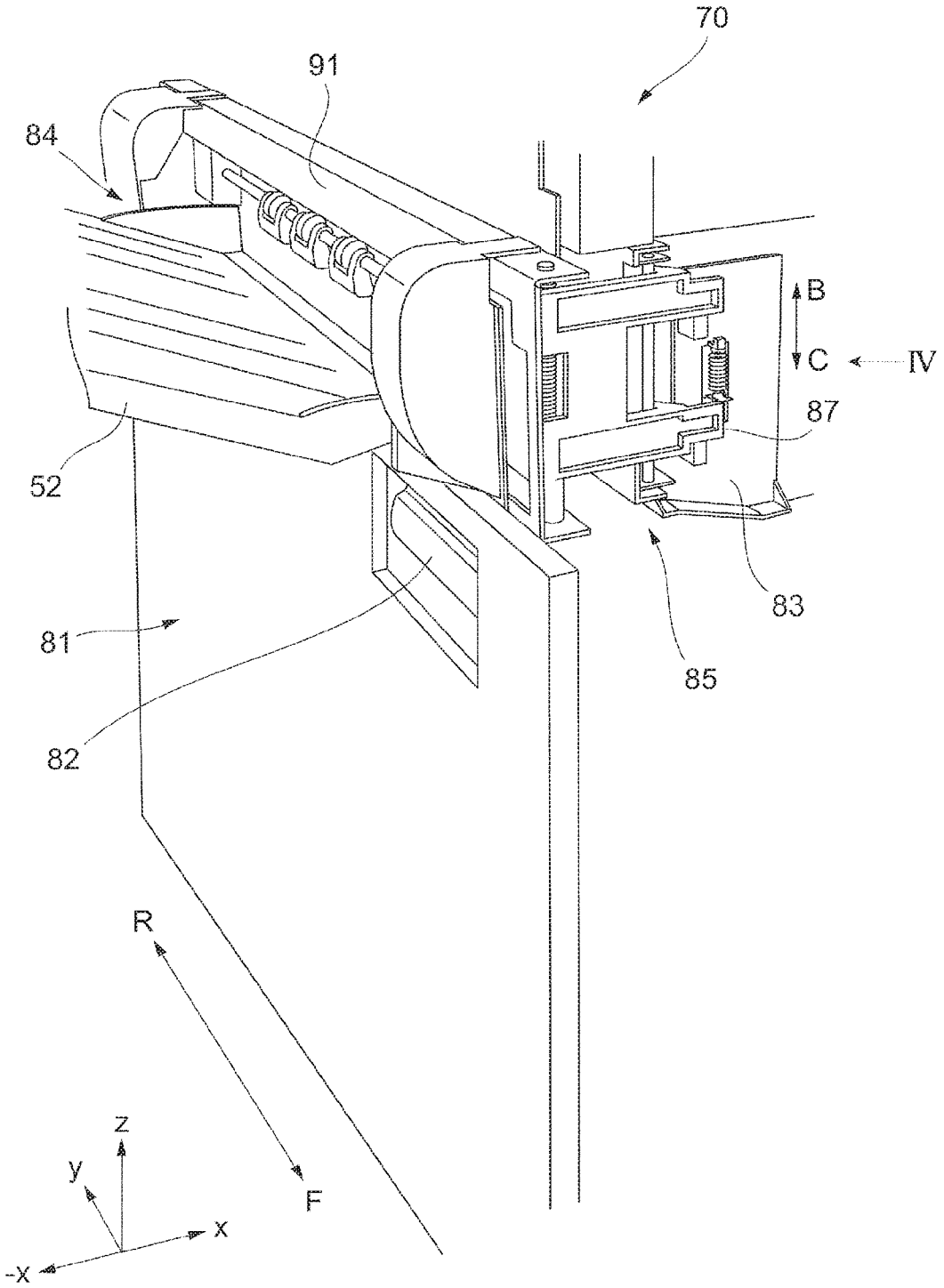
FIG. 3 illustrates a configuration of a lower cover and a downstream path cover and is a perspective view of the sheet transporting section when viewed from the direction III illustrated in FIG. 1.
Figure 4:
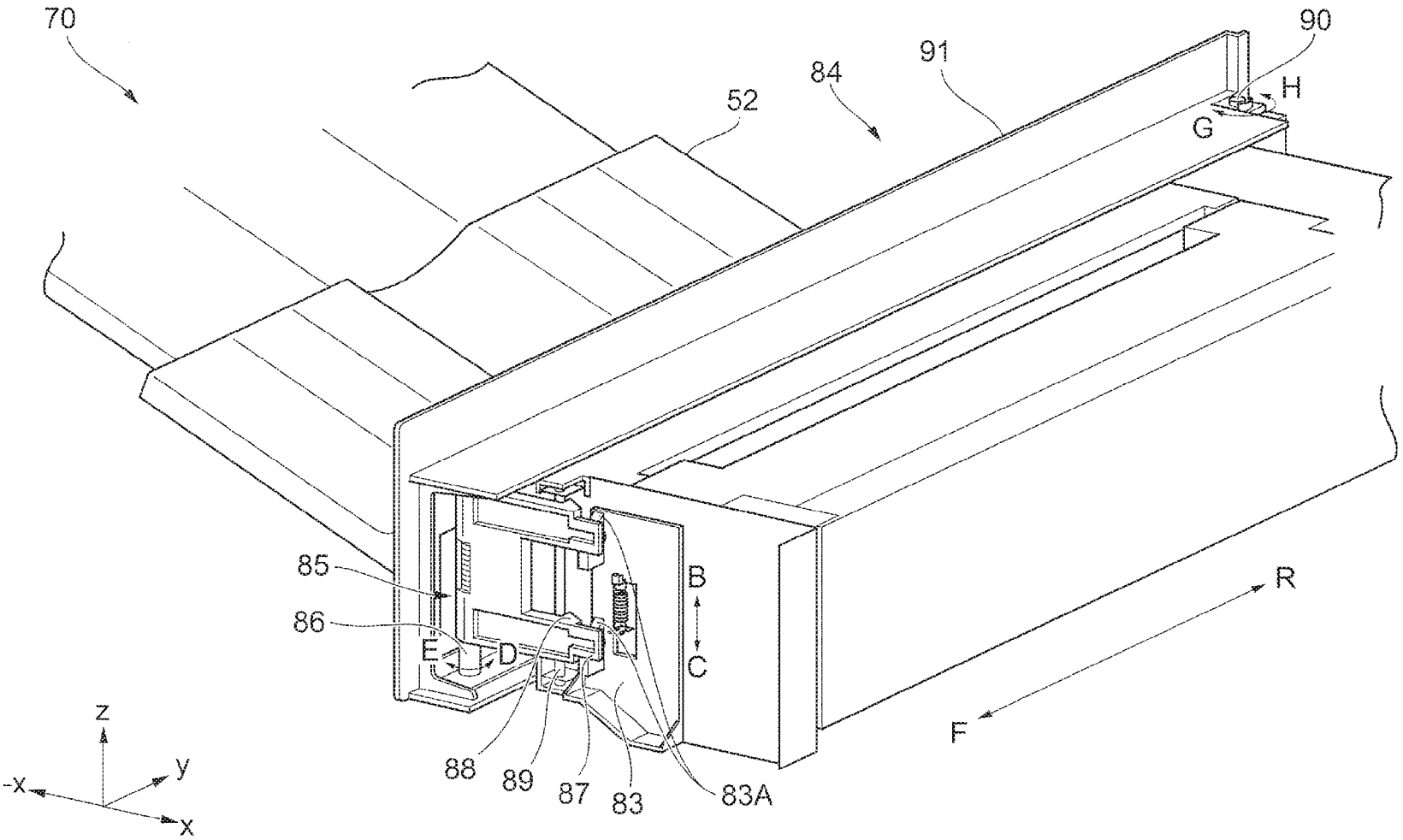
FIG. 4 illustrates a configuration of a latch portion of a downstream path cover.
Figure 5:
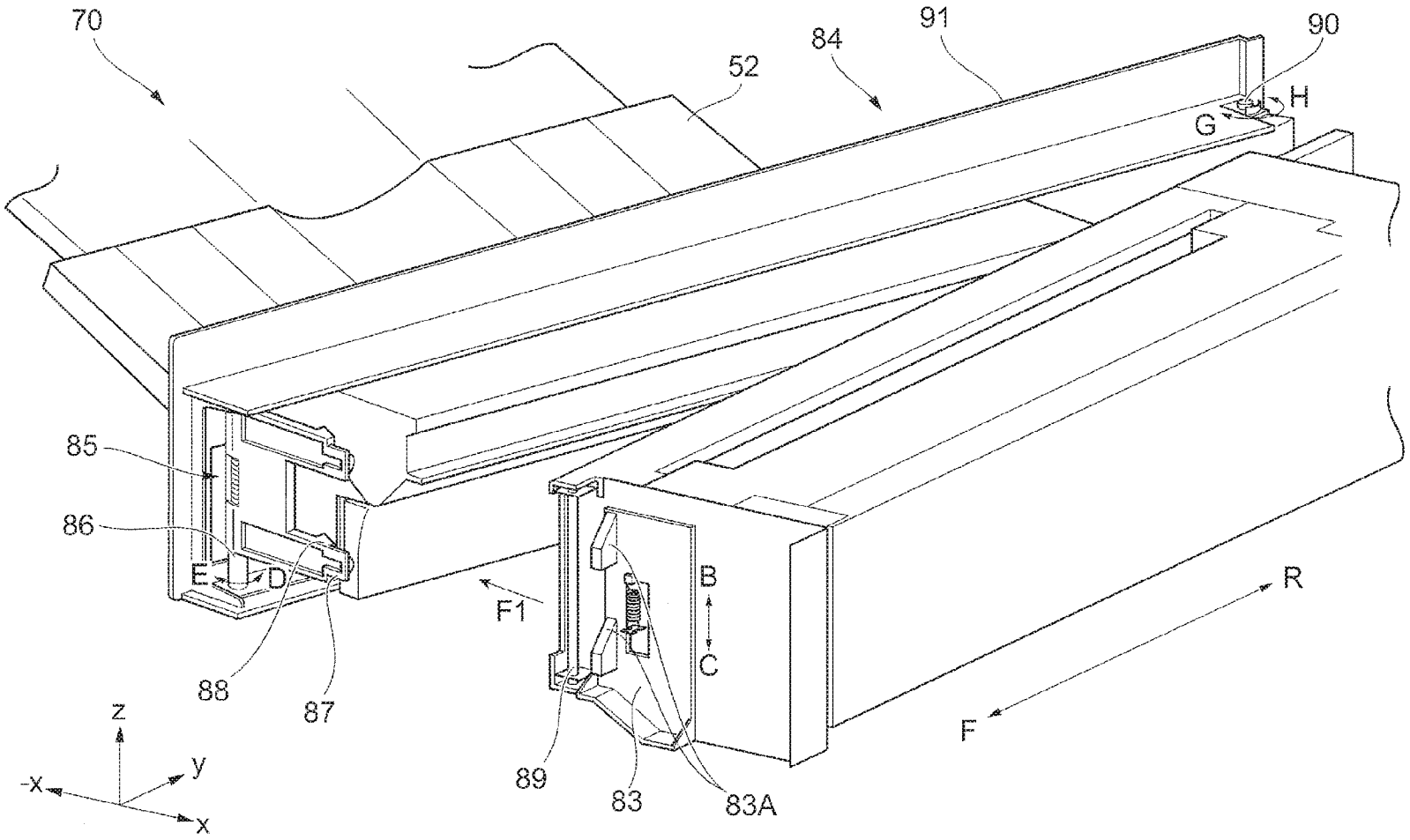
FIG. 5 illustrates the downstream path cover in the open state.

FIG. 3 illustrates the configuration of the lower cover 81 and the downstream path cover 84 and is a perspective view of the sheet transporting section 70 when viewed from the direction III illustrated in FIG. 1. FIG. 4 is an enlarged view of a latch mechanism for fixing the downstream path cover 84 in position to the body of the sheet transporting section 70 when the sheet transporting section 70 is viewed from the direction IV illustrated in FIG. 3. FIG. 5 illustrates the state where the downstream path cover 84 is opened so as to uncover the body of the sheet transporting section 70.

The lower cover 81, which is an example of a third open-close portion, includes an operation handle 82 and a moving mechanism portion 83. The operation handle 82 is handled by a user when the user opens or closes the lower cover 81. The moving mechanism portion 83 is disposed at a portion downstream of the operation handle 82 in the x direction of FIG. 3 and coupled to the operation handle 82.

Except when the user handles the handle 82, the operation handle 82 is engaged with the body of the sheet transporting section 70 to fix the lower cover 81 in position to the body of the sheet transporting section 70.

When a user grips the operation handle 82 and pulls the operation handle 82 in the −x direction illustrated in FIG. 3, the operation handle 82 becomes disengaged from the body of the sheet transporting section 70. Thus, the lower cover 81 is opened so as to uncover the body of the sheet transporting section 70 by rotating around its rotation shaft, not illustrated, and falling in the −x direction.

The moving mechanism portion 83 includes a slant portions 83A extending obliquely downward in the direction opposite to the y direction.

When a user grips the operation handle 82 and pulls the operation handle 82 in the −x direction illustrated in FIG. 3, the moving mechanism portion 83 coupled to the operation handle 82 ascends in the direction of arrow B in FIG. 3. When the user lets go of the operation handle 82, the moving mechanism portion 83 that has been ascending descends in the direction of arrow C in FIG. 3 and returns to the position at which it is positioned before ascending.

The downstream path cover 84, which is an example of a first open-close portion, includes a rotation shaft 90 at the end of the downstream path cover 84 in the y direction in FIG. 4. The downstream path cover 84 also includes a rotatable external door 91, which extends in the y direction in FIG. 4 and is openable to uncover and closeable to cover the body of the sheet transporting section 70 by rotating around the rotation shaft 90. The downstream path cover 84 also includes a latch portion 85, which is disposed at the upstream end of the rotatable external door 91 in the y direction in FIG. 4 so as to extend in the x direction in FIG. 4. The latch portion 85 fixes the downstream path cover 84 in position to the body of the sheet transporting section 70.

The latch portion 85 includes a rotation shaft 86, disposed at the upstream end of the latch portion 85 in the x direction in FIG. 4, and protrusions 87, disposed so as to extend from the rotation shaft 86 in the x direction in FIG. 4 and so as to touch the slant portions 83A of the moving mechanism portion 83. The latch portion 85 also includes hooked portions 88, which are diverged from the respective protrusions 87 and extend in the y direction in FIG. 4, and a restricting pin 89, disposed at a portion further upstream of the hooked portions 88 in the x direction. The restricting pin 89 touches the hooked portions 88 to restrict movement of the latch portion 85 in the −x direction in FIG. 4.

The latch portion 85 receives a force in the direction of arrow D in FIG. 4 (counterclockwise in FIG. 4) from a spring disposed on the rotation shaft 86.

The rotatable external door 91 receives a pressing force F1, which is a reaction force against the nip pressure, in the −x direction of FIG. 4 from the roller 72B of the second transport rollers 72. The movement of the rotatable external door 91 in the −x direction, however, is restricted since the hooked portions 88 are in contact with and hooked on the restricting pin 89.

When the moving mechanism portion 83 ascends as a result of a user griping the operation handle 82 and pulling the operation handle 82 in the −x direction in FIG. 4, the protrusions 87 are pushed by the slant portions 83A in the direction opposite to the y direction in FIG. 4. As the moving mechanism portion 83 ascends further, the latch portion 85 rotates further in the direction of arrow E in FIG. 4 against the force of the spring on the rotation shaft 86.

After the latch portion 85 rotates by a predetermined distance in the direction of arrow E in FIG. 4, the hooked portions 88 and the restricting pin 89 become no longer in contact with one another. Thus, the movement of the latch portion 85 in the −x direction in FIG. 4 is no longer restricted by the restricting pin 89. Thus, the rotatable external door 91 rotates in the direction of arrow G in FIG. 4 (clockwise in FIG. 4) around the rotation shaft 90 by the pressing force F1 exerted from the roller 72B in the −x direction in FIG. 4. Thus, the rotatable external door 91 is opened so as to uncover the body of the sheet transporting section 70.

Here, the downstream path cover 84 is an example of a first rotatable door.

Description of Configuration of Upstream Path Cover

Figure 6:
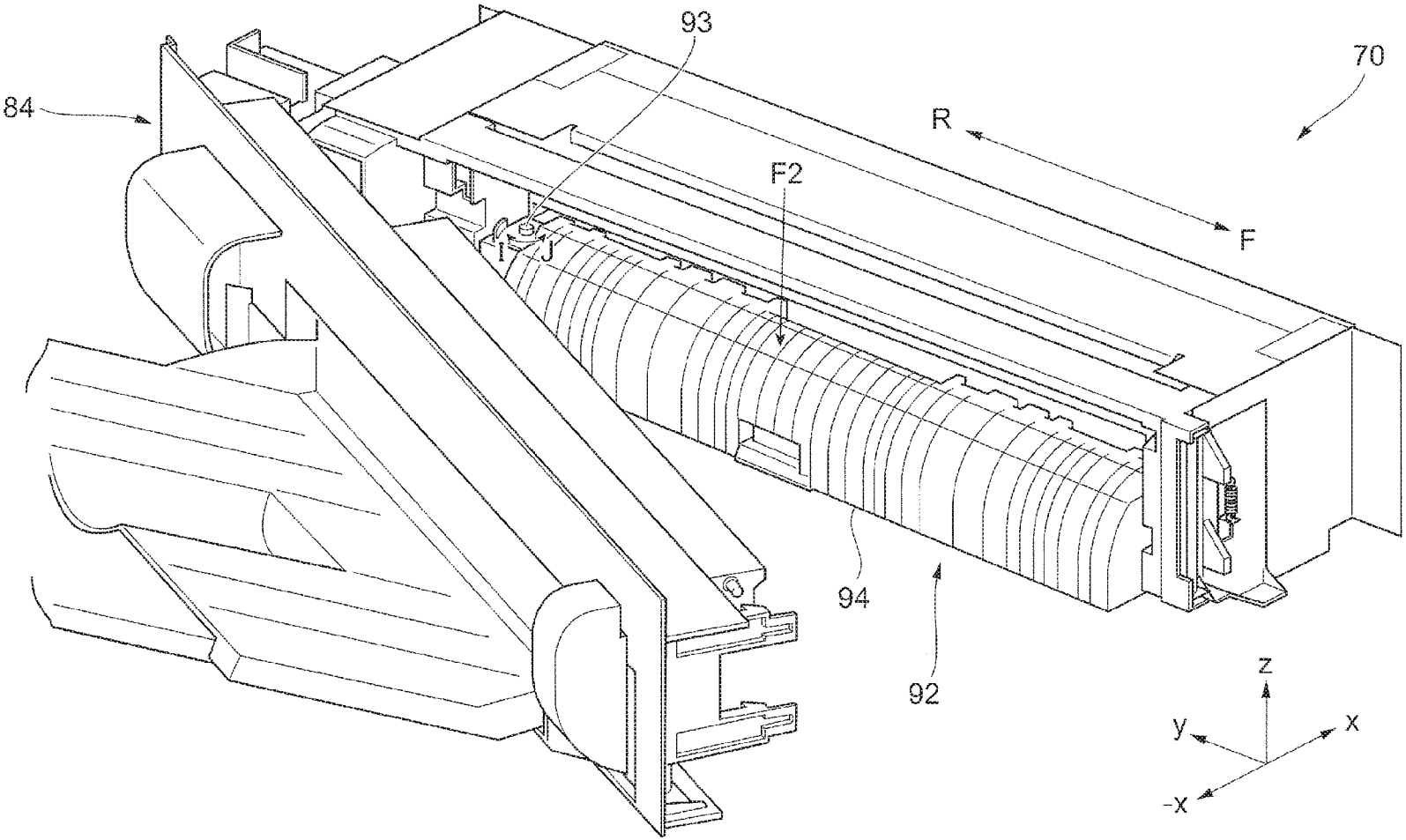
FIG. 6 illustrates a configuration of an upstream path cover.
Figures 7A, 7B:
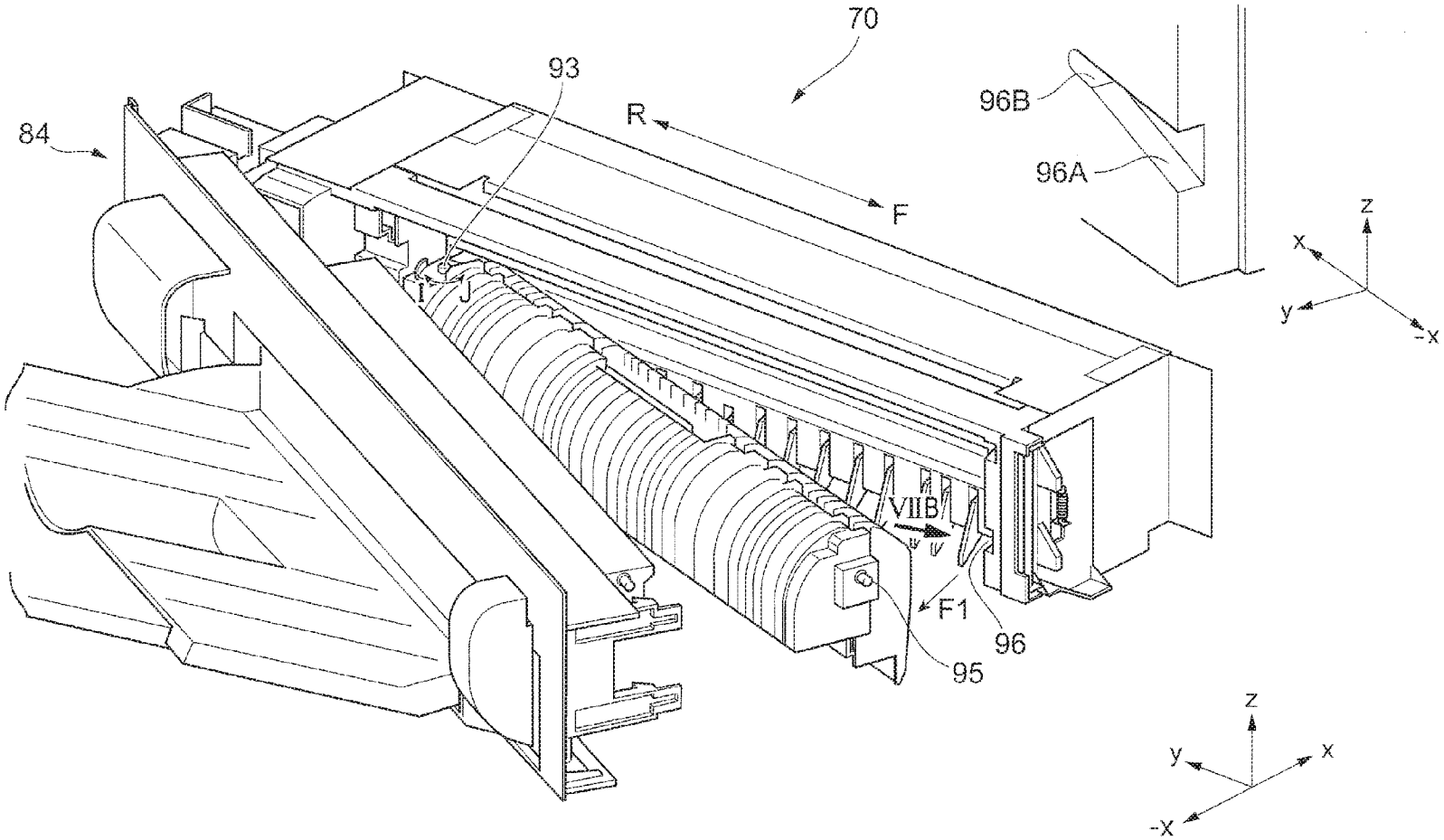
FIG. 7A illustrates the upstream path cover in the open state and FIG. 7B illustrates the configuration that determines the position at which the upstream path cover is closed, the configuration being viewed from the direction VIIB illustrated in FIG. 7A.

FIG. 6 is a diagram of the configuration of the upstream path cover 92 and illustrates the state where the downstream path cover 84 is opened so as to uncover the body of the sheet transporting section 70. FIG. 7A illustrates the state where the upstream path cover 92 is opened so as to uncover the body of the sheet transporting section 70. FIG. 7B is a diagram of the configuration that determines the position of the upstream path cover 92 in which the upstream path cover 92 is closed so as to cover the body of the sheet transporting section 70, when viewed from the direction VIIB in FIG. 7A.

The upstream path cover 92, which is an example of a second open-close portion, includes a rotation shaft 93, disposed at the end of the upstream path cover 92 in the y direction of FIG. 6, and a rotatable internal door 94 disposed so as to extend in the y direction of FIG. 6 and so as to be openable to uncover and closeable to cover the body of the sheet transporting section 70 by rotating around the rotation shaft 93. The upstream path cover 92 includes a positioning pin 95 used for positioning the upstream path cover 92 while the upstream path cover 92 is closed so as to cover the body of the sheet transporting section 70.

The upstream path cover 92 also includes a slot 96 that allows the positioning pin 95 to be fitted thereinto to fix the upstream path cover 92 in position. The slot 96 includes a guide portion 96A, with which a lower portion of the positioning pin 95 comes into contact and which extends obliquely upward in the x direction, and a flat portion 96B, extending in the x direction of FIG. 7B from the guide portion 96A.

While the downstream path cover 84 is closed, the rotatable internal door 94 is pushed by the downstream path cover 84 in the x direction of FIG. 6 and closed so as to cover the body of the sheet transporting section 70. The positioning pin 95 is fixed in position at the end of the flat portion 96B of the slot 96 in the x direction of FIG. 7B. At this time, the pressing force from the downstream path cover 84 in the x direction in FIG. 7A is transmitted to the rotation shaft of the roller 72B of the second transport rollers 72 via the rotatable internal door 94. Thus, the nip pressure occurs in the second transport rollers 72. When the rotatable internal door 94 is closed so as to cover the body of the sheet transporting section 70, the rotatable internal door 94 pushes the rotation shaft of the roller 75B of the diverging rollers 75 upward. Thus, the nip pressure occurs in the diverging rollers 75.

Meanwhile, the rotatable internal door 94 receives the pressing force F2, which is a reaction force against the nip pressure of the diverging rollers 75 and exerts downward, from the spring of the rotation shaft of the roller 75B.

Figure 8:
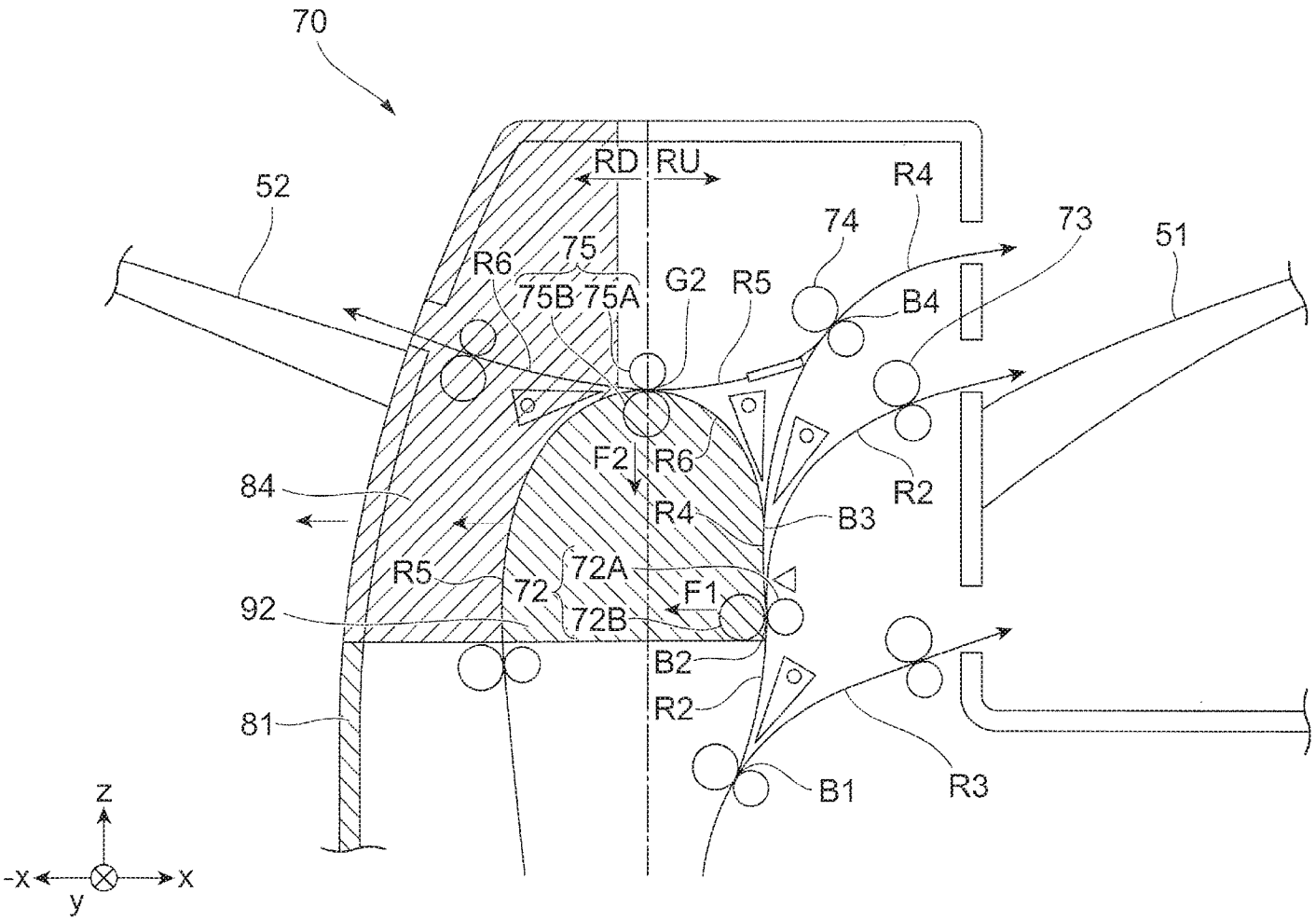
FIG. 8 illustrates the range of a sheet transport path and a transport roller included in each of a downstream path cover and an upstream path cover.

The rotatable internal door 94 also receives the pressing force F1, which is a reaction force against the nip pressure of the second transport rollers 72 and exerts in the −x direction in FIG. 8, from the spring of the rotation shaft of the roller 72B. This force is transmitted to the downstream path cover 84. Here, the movement of the downstream path cover 84 is restricted since the latch portion 85 is engaged with the body of the sheet transporting section 70. Thus, the movement of the rotatable internal door 94 in the −x direction of FIG. 6 is restricted by the downstream path cover 84.

As described above, however, when the restriction of the latch portion 85 is removed, the downstream path cover 84 is opened so as to uncover the body of the sheet transporting section 70 by rotation.

Thus, the restriction of the downstream path cover 84 is removed and the rotatable internal door 94 rotates together with the rotation of the downstream path cover 84. Specifically, the rotatable internal door 94 is opened so as to uncover the sheet transporting section 70 by rotating around the rotation shaft 93 in the direction of arrow I.

As the rotatable internal door 94 rotates further in the direction of arrow I in FIG. 6, the positioning pin 95 moves in the −x direction of FIG. 7B over the flat portion 96B. When the positioning pin 95 passes the flat portion 96B and arrives at the guide portion 96A, the positioning pin 95 descends as it moves further in the −x direction by the pressing force F2 exerted from the diverging rollers 75. Thereafter, the positioning pin 95 passes the guide portion 96A and moves away from the slot 96. Thus, the rotatable internal door 94 is opened so as to uncover the body of the sheet transporting section 70.

When the downstream path cover 84 is pushed in the x direction of FIG. 6 to be moved in such a direction as to cover the body of the sheet transporting section 70, the upstream path cover 92 is pushed by the downstream path cover 84 and rotated in the direction of arrow J in FIG. 6. Thus, the positioning pin 95 is moved toward the slot 96 in the x direction of FIG. 7A. As the positioning pin 95 moves further over the guide portion 96A in the x direction of FIG. 7B, the upstream path cover 92 ascends further. When the positioning pin 95 passes the guide portion 96A and arrives at the flat portion 96B, the height of the upstream path cover 92 is fixed. Thereafter, when the hooked portions 88 of the downstream path cover 84 arrive at the positions at which the hooked portions 88 are allowed to be hooked on the restricting pin 89, the positioning pin 95 arrives at the end of the slot 96 in the x direction. Thus, the upstream path cover 92 is fixed in position.

In this exemplary embodiment, when the restriction on the movement of the downstream path cover 84 is removed, the downstream path cover 84 and the upstream path cover 92 are opened to uncover the sheet transporting section 70 by the pressing force F1 from the second transport rollers 72 without the need for users to perform opening and closing operations.

The upstream path cover 92 is opened together with the downstream path cover 84 in response to opening of the downstream path cover 84.

In addition, when a user closes the downstream path cover 84, the upstream path cover 92 is closed together with the downstream path cover 84.

Here, the upstream path cover 92 is an example of a second rotatable door.

Description of Range of Sheet Transport Paths and Transport Rollers that Move in Response to Opening of Upstream Path Cover or Downstream Path Cover FIG. 8 illustrates the range of the sheet transport paths and transport rollers that move in response to opening of the downstream path cover 84 or the upstream path cover 92.

A wall surface (not illustrated) constituting a portion of the sixth sheet transport path R6 downstream of the merging point G2 in the transportation direction is located adjacent to the downstream path cover 84. Part of a wall surface (not illustrated) constituting a portion of the fifth sheet transport path R5 extending from the merging point G2 to the level up to which the lower cover 81 extends is located adjacent to the downstream path cover 84.

Specifically, among the wall surfaces constituting the fifth sheet transport path R5, the wall surface located closer to the first side surface of the sheet transporting section 70, on which the downstream path cover 84 is disposed, than the opposing wall surface is adjacent to the downstream path cover 84.

When the downstream path cover 84 moves in the −x direction, the wall surface adjacent to the downstream path cover 84 also moves concurrently. Thus, the sheet transport path is rendered open. A user is thus allowed to remove paper jam in the opened sheet transport path.

In this exemplary embodiment, the downstream path RD is rendered open by opening the downstream path cover 84 and the lower cover 81.

Among the wall surfaces constituting the fourth sheet transport path R4 from the diverging point B2 to the diverging point B3, the wall surface located closer to the first side surface of the sheet transporting section 70, on which the downstream path cover 84 is disposed, than the opposing wall surface is located adjacent to the upstream path cover 92. In addition, among the wall surfaces constituting the sixth sheet transport path R6 from the diverging point B3 to the merging point G2, the wall surface located closer to the roller 75B than the opposing wall surface is located adjacent to the upstream path cover 92.

Further, among the wall surfaces constituting the fifth sheet transport path R5 from the merging point G2 to the lower cover 81, the wall surface located farther from the first side surface of the sheet transporting section 70, on which the downstream path cover 84 is disposed, than the opposing wall surface is located adjacent to the upstream path cover 92.

In addition, the roller 75B of the diverging rollers 75 and the roller 72B of the second transport rollers 72 are attached to the upstream path cover 92.

When the upstream path cover 92 moves in the −x direction, the wall surface adjacent to the upstream path cover 92 also moves concurrently.

In this exemplary embodiment, the upstream path RU is rendered open by opening the downstream path cover 84 and the upstream path cover 92.

A user is allowed to remove paper jam in the downstream path RD by opening the downstream path cover 84 and the lower cover 81 and allowed to remove paper jam in the upstream path RU by opening the upstream path cover 92.

When paper jam occurs in only the upstream path RU, a user fails to remove the paper jam if merely the downstream path cover 84 is opened. Even in this case, both of the downstream path cover 84 and the upstream path cover 92 are opened, and thus a user is allowed to remove paper jam.

When the downstream path cover 84 is opened, the upstream path cover 92 is opened concurrently. Thus, in the case where paper jam occurs in only the upstream path RU, a user is allowed to remove the paper jam in the upstream path RU by performing an operation for opening the downstream path cover 84 without performing an operation for opening the upstream path cover 92.

When the upstream path cover 92 moves in the −x direction in FIG. 8, the wall surfaces and the transport rollers attached to the upstream path cover 92 move concurrently. Thus, the spring of the rotation shaft of the roller 75B becomes separated from the rotation shaft of the roller 75A, so that the nip pressure no longer occurs in the diverging rollers 75. In addition, when the spring of the rotation shaft of the roller 72B becomes separated from the rotation shaft of the roller 72A, the nip pressure no longer occurs in the second transport rollers 72.

When the nip pressure does not occur in the diverging rollers 75, the pressing force F2 exerted by the spring of the rotation shaft of the roller 75B as a reaction force of the nip pressure no longer occurs.

When the nip pressure does not occur in the second transport rollers 72, the pressing force F1 exerted by the spring of the rotation shaft of the roller 72B as a reaction force of the nip pressure no longer occurs. Thus, the downstream path cover 84 and the upstream path cover 92, which have been receiving the pressing force F1 and moving in the −x direction of FIG. 8, are stopped from moving.

In some cases, a sheet P is jammed over the range extending from a portion of the fifth sheet transport path R5, attached to the downstream path cover 84 or the upstream path cover 92, to the downstream side of the fifth sheet transport path R5, to which the downstream path cover 84 or the upstream path cover 92 is not attached. When the downstream path cover 84 is opened to remove paper jam, the upstream path cover 92 is also opened. However, since the pressing force F1 is no longer exerted from the second transport rollers 72, the upstream path cover 92 is not completely opened to uncover the body of the sheet transporting section 70 and stops moving halfway.

Thus, a sheet P stuck between the downstream path cover 84 and the upstream path cover 92 is prevented from coming into contact with and damaging the wall surface on the downstream side of the fifth sheet transport path R5, although the sheet P would otherwise come into contact with and damage the wall surface if the downstream path cover 84 and the upstream path cover 92 are only allowed to move in an integrated manner and are opened.

In some other cases, paper jam occurs in the state where a sheet P is stuck between the diverging rollers 75 or the second transport rollers 72. In this exemplary embodiment, when the downstream path cover 84 is opened, the upstream path cover 92 is opened up to the position at which the nip pressure exerted from the diverging rollers 75 and the nip pressure exerted from the second transport rollers 72 no longer occur.

Thus, the jammed sheet P is prevented from being damaged, although the sheet P would otherwise be damaged by the nip pressure being exerted thereon from the transport rollers in the direction different from the direction from which the sheet P is removed.

In some other cases, paper jam occurs in the state where a sheet P is stuck between the diverging rollers 75 or the second transport rollers 72 and the leading end of the sheet P extends to the downstream path RD. In this case, when the downstream path cover 84 is opened, the upstream path cover 92 is opened up to the position at which the nip pressure exerted from the diverging rollers 75 and the nip pressure exerted from the second transport rollers 72 no longer occur.

Thus, a user is allowed to remove paper jam without completely opening the upstream path cover 92 and without subjecting a sheet P to damage due to the nip pressure.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording medium transporting device, comprising:

a transport path along which a recording medium on which an image is formed is transported;

a first open-close portion disposed on a side surface of the transporting device so as to be openable to uncover and closeable to cover the transporting device, the first open-close portion rendering a first portion of the transport path open when the first open-close portion is opened so as to uncover the transporting device;

a second open-close portion disposed inside the transporting device at a position further inward of the first open-close portion so as to be openable to uncover and closeable to cover the transporting device, the second open-close portion rendering a second portion of the transport path different from the first portion of the transport path open when the second open-close portion is opened so as to uncover the transporting device; and a third open-close portion disposed below the first open-close portion so as to be openable to uncover and closeable to cover the transporting device, the third open-close portion rendering a third portion of the transport path different from the first portion and the second portion of the transport path open when the third open-close portion is opened so as to uncover the transporting device, wherein the first open-close portion is configured to be opened in response to opening of the third open-close portion.

2. The recording medium transporting device according to claim 1, wherein the second open-close portion is configured to be opened in response to opening of the first open-close portion.

3. The recording medium transporting device according to claim 1, further comprising:

a downstream transporting portion configured to transport to a downstream side the recording medium transported from an upstream side in a transportation direction, wherein the transport path includes a first transport path, over which the recording medium is transported further downstream in the transportation direction beyond the downstream transporting portion, and wherein the first transport path is rendered open when the first open-close portion and the third open-close portion are opened.

4. The recording medium transporting device according to claim 3, wherein the first transport path is a portion of the transport path located in an area extending from the downstream transporting portion toward the first open-close portion.

5. The recording medium transporting device according to claim 3, wherein the transport path includes a second transport path, over which the recording medium located upstream of the downstream transporting portion in the transportation direction is transported, and wherein the second transport path is rendered open when the second open-close portion is opened.

6. The recording medium transporting device according to claim 5, wherein the second transport path is located opposite to the first transport path with respect to the downstream transporting portion.

7. The recording medium transporting device according to claim 5, further comprising:

an upstream transporting portion disposed on the second transport path and configured to exert a pressing force on the recording medium transported over the second transport path to transport the recording medium downstream in the transportation direction, wherein the upstream transporting portion is configured to push the first open-close portion and the second open-close portion to open the first open-close portion and the second open-close portion.

8. The recording medium transporting device according to claim 7, wherein, as the second open-close portion is opened, the pressing force of the upstream transporting portion is reduced.

9. The recording medium transporting device according to claim 1, wherein the second open-close portion is configured to be closed so as to cover the transporting device as a result of being pushed by the first open-close portion.

10. A recording medium transporting device, comprising:

a transport path along which a recording medium on which an image is formed is transported;

a first rotatable door disposed on a side surface of the transporting device, the first rotatable door rendering a first portion of the transport path open when the first rotatable door is opened so as to uncover the transporting device by rotating around a rotation shaft of the first rotatable door;

a second rotatable door rendering a second portion of the transport path different from the first portion of the transport path open when the second rotatable door is opened so as to uncover the transporting device by rotating around a rotation shaft of the second rotatable door different from the rotation shaft of the first rotatable door; and a third rotatable door disposed below the first rotatable door, the third rotatable door rendering a third portion of the transport path different from the first portion and the second portion of the transport path open when the third rotatable door is open so as to uncover the transporting device, wherein the first rotatable door is configured to be opened in response to opening of the third rotatable door.

11. An image forming apparatus, comprising:

an image forming section configured to form an image on a recording medium;

an ejection portion to which the recording medium on which the image is formed by the image forming section is ejected;

a transport path along which the recording medium is transported downstream in a transportation direction or toward the ejection portion;

a first open-close portion disposed on a side surface of the transporting device so as to be openable to uncover and closeable to cover the transporting device, the first open-close portion rendering a first portion of the transport path open when the first open-close portion is opened so as to uncover the transporting device;

a second open-close portion located inside the transporting device at a position further inward of the first open-close portion so as to be openable to uncover and closeable to cover the transporting device, the second open-close portion rendering a second portion of the transport path different from the first portion of the transport path open when the second open-close portion is opened so as to uncover the transporting device; and a third open-close portion disposed below the first open-close portion so as to be openable to uncover and closeable to cover the transporting device, the third open-close portion rendering a third portion of the transport path different from the first portion and the second portion of the transport path open when the third open-close portion is opened so as to uncover the transporting device, wherein the first open-close portion is configured to be opened in response to opening of the third open-close portion.

* * * * *